US005291212A

United States Patent [19]

Cox

[11] Patent Number: 5,291,212

[45] Date of Patent: Mar. 1, 1994

[54] GRID-TYPE PARABOLOIDAL MICROWAVE ANTENNA

[75] Inventor: Gary A. Cox, Victoria, Australia

[73] Assignee: Andrew Corporation, Orland Park, Ill.

[21] Appl. No.: 938,822

[22] Filed: Sep. 1, 1992

[51] Int. Cl.[5] ..... H01Q 15/16

[52] U.S. Cl. ..... 343/840; 343/916

[58] Field of Search ..... 343/840, 915, 916, 912; H01Q 15/14, 15/16, 19/12

[56] References Cited

U.S. PATENT DOCUMENTS

| | | | |
|---|---|---|---|
| D. 269,009 | 5/1983 | Mann et al. | D14/86 |
| D. 275,100 | 8/1984 | Mann et al. | D14/86 |
| 2,423,648 | 7/1947 | Hansell | 343/916 |
| 2,530,098 | 11/1950 | Atta | 343/840 |
| 2,703,842 | 3/1955 | Lewis | 343/840 |
| 2,850,735 | 9/1958 | Harris | 343/840 |
| 3,178,713 | 4/1965 | Yang | 343/840 |
| 4,647,943 | 3/1987 | Metcalfe | 343/916 |
| 4,801,946 | 1/1989 | Matz, Jr. | 343/840 |
| 4,860,022 | 8/1989 | Dobroski | 343/840 |

*Primary Examiner*—Michael C. Wimer
*Attorney, Agent, or Firm*—Arnold, White & Durkee

[57] ABSTRACT

A grid-type microwave antenna comprises a multiplicity of generally parallel conductive rods. Each rod is curved along its length to form a section of a paraboloid so that when all the rods are positioned parallel to each other, in spaced apart relationship to each other, they form a paraboloidal reflector. A rim includes insulating members for receiving and holding the ends of the rods to position the rods in spaced apart and parallel relationship to each other.

11 Claims, 4 Drawing Sheets

GRID-TYPE PARABOLOIDAL MICROWAVE ANTENNA

FIELD OF THE INVENTION

The present invention relates generally to microwave antennas and, more particularly, to grid-type microwave antennas in which a plurality of spaced conductive rods form a paraboloidal reflecting surface.

BACKGROUND OF THE INVENTION

Grid-type microwave antennas have been known for many years. These antennas offer certain advantages over antennas in which the reflecting surface is formed from one or more solid sheets of metal. Specifically, the grid antennas provide low wind loads, and their light weight reduces shipping and handling costs. They can also be shipped in totally disassembled form, in relatively small containers, and then assembled at the site where they are to be installed.

One of the problems with grid antennas, however, is the time required to carry out the many steps involved in assembling such antennas. A grid antenna is made up of a very large number of parts, including the dozens of rods which form the reflective grid. The time-consuming assembly operations increase the cost of the antenna, regardless of whether it is assembled at the manufacturing site or at the installation site. The complex assembly operation makes these antennas unattractive for certain customers, and can require the presence of specially trained personnel at an installation site.

SUMMARY OF THE INVENTION

It is, therefore, a primary object of the present invention to provide an improved grid-type microwave antenna which can be easily and quickly assembled, even by untrained personnel.

A related object of the invention is to provide such an improved grid-type microwave antenna which is relatively inexpensive to assemble regardless of whether the assembly is done at the manufacturing site or at the installation site.

Another object of this invention is to provide such an improved grid-type microwave antenna which comprises a relatively small number of parts.

Still another object of the invention is to provide an improved grid-type microwave antenna which can be easily adapted for operation at any desired frequency.

A further object of the invention is to provide such an improved grid-type antenna which protects non-metallic components from exposure to the sun.

Other objects and advantages of the invention will be apparent from the following detailed description and accompanying drawings.

Another object of the invention is to protect the plastic insulating strips from exposure to sunlight by enclosing them within the channel section.

In accordance with the present invention, the foregoing objectives are realized by providing a grid-type microwave antenna comprising a multiplicity of generally parallel conductive rods, each of which is curved along its length to form a section of a paraboloid so that when all the rods are positioned in parallel spaced apart relationship to each other, they form a paraboloidal reflector, and a rim including insulating members for receiving and holding the ends of the rods to position the rods in spaced apart and parallel relationship to each other. The rim forms a channel for receiving the ends of the rods, and an insulating strip secured to the rim covers the entry to the channel. The insulating strip has multiple holes formed therein to admit the ends of the rods into the channel so that the strip holds the rods in the desired spaced relationship to each other. A support arch extends across the central portions of the rods, orthogonally to the rods, and is connected at its opposite ends to the rim. An insulating strip is attached to the arch and forms multiple holes for passing the rods through the strip so that the strip holds the central portions of the rods in the desired spaced relationship to each other.

DETAILED DESCRIPTION OF THE PREFERRED EMBODIMENT

Figure 1:
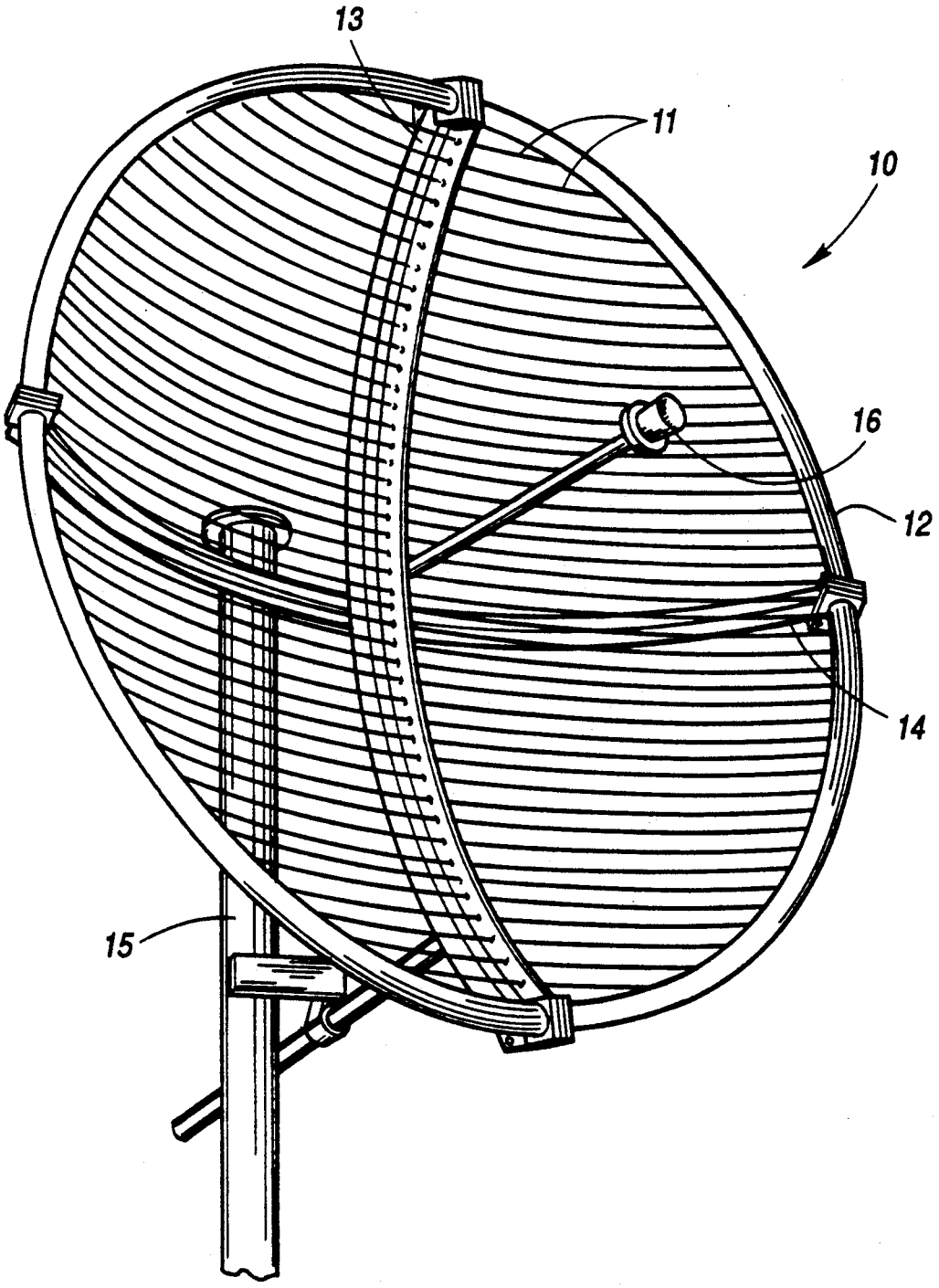
FIG. 1 is a perspective view of a grid antenna embodying the present invention.

While the invention is susceptible to various modifications and alternative forms, specific embodiments thereof have been shown by way of example in the drawings and will be described in detail herein. It should be understood, however, that it is not intended to limit the invention to the particular forms disclosed, but on the contrary, the intention is to cover all modifications, equivalents and alternatives falling within the spirit and scope of the invention as defined by the appended claims.

Turning now to the drawings and referring first to FIG. 1, there is shown a grid-type microwave antenna 10 in which an array of parallel conductive rods 11, typically made of aluminum, form a paraboloidal reflecting surface for microwave energy. The rods 11 are held in place by a rigid rim 12 surrounding the array of rods, and a central support arch 13 extending diametrically across the rim to provide additional support for the central portions of the rods 11. A second support arch 14 extends diametrically across the rim orthogonally to the arch 13.

Each of the rods 11 is curved so that it forms a section of a paraboloidal surface. Then when the rods 11 are all properly assembled in a parallel array, the entire array defines a paraboloidal reflecting surface. As is well known, the spaces between the adjacent rods 11 must be related to the wavelength of the microwave signals at the operating frequency of the antenna.

It will, of course, be understood that the illustrated antenna 10 is designed to be employed with a suitable mount attached to the back for securing the antenna to a tower 15 or other elevated structure. Also, a conventional feed device 16 is provided on the front side of the antenna for transmitting microwave energy to, and or receiving microwave energy from, the reflector formed by the array of parallel rods 11.

Figure 2:
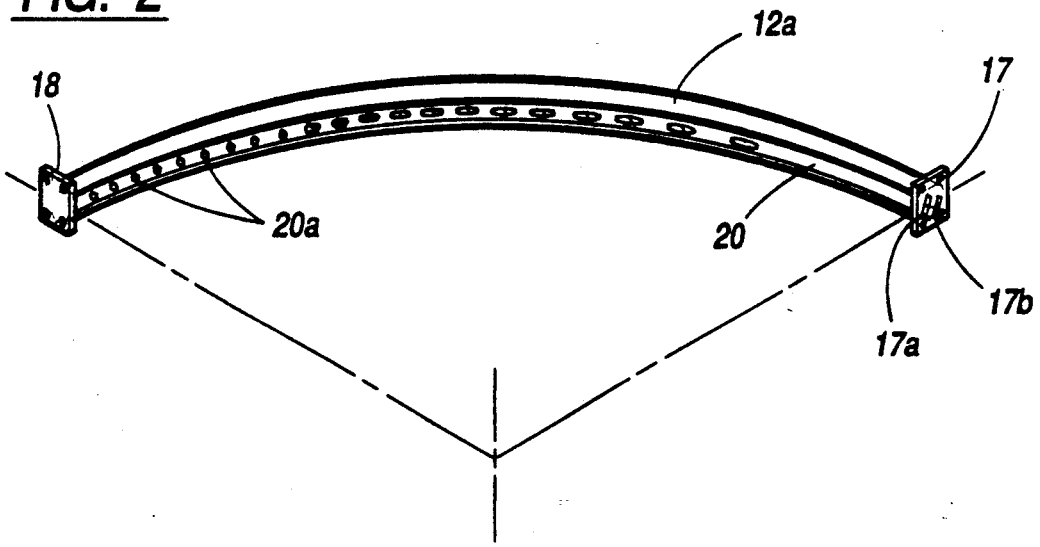
FIG. 2 is a perspective view of one of the sections of the rim in the antenna of FIG. 1.
Figure 6:
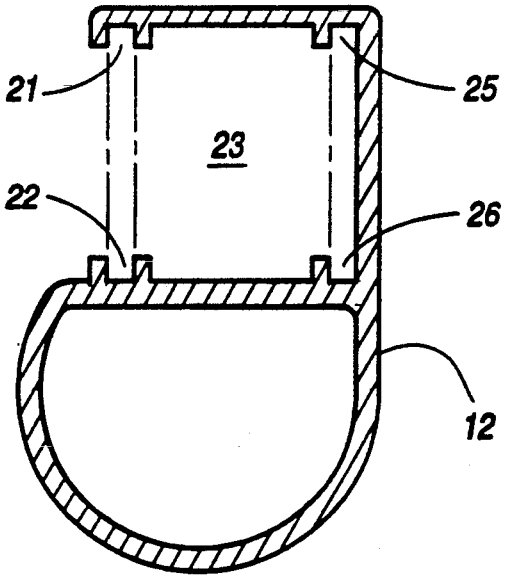
FIG. 6 is an enlarged section taken generally along line 6—6 in FIG. 2.
Figure 7:
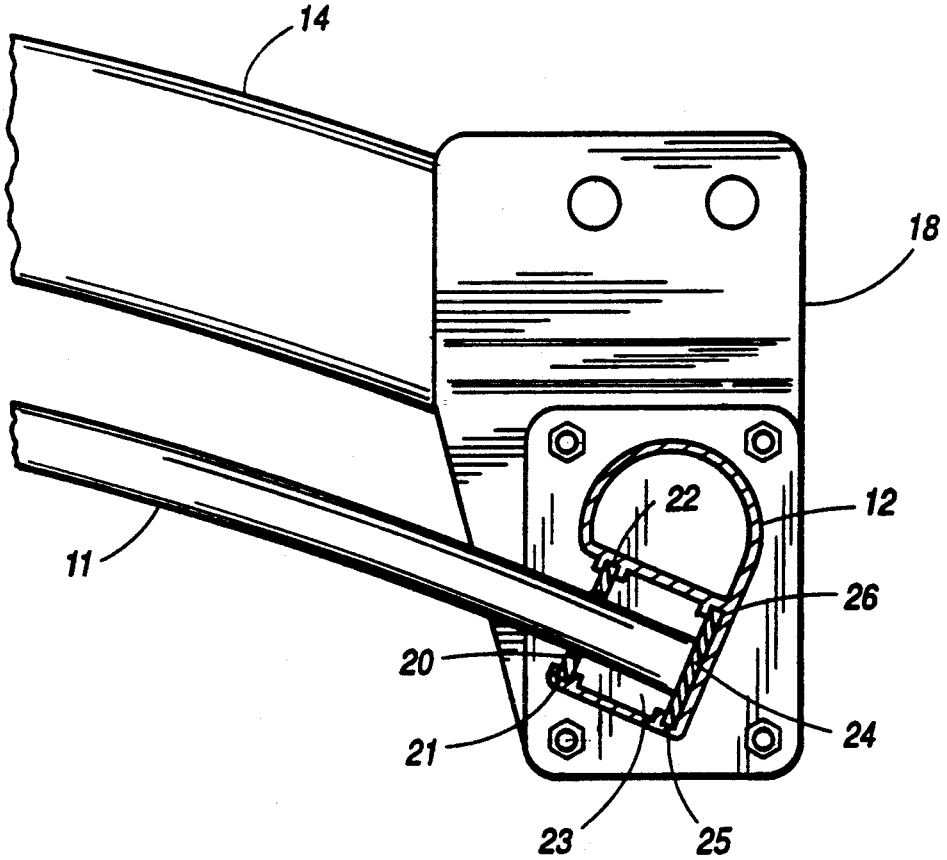
FIG. 7 is an enlarged section taken generally along line 7—7 in FIG. 4.

As can be seen in FIGS. 2 and 7, the rim 12 includes an insulating strip 20 for receiving and holding the ends of the rods 11 in the desired spaced-apart and parallel relationship to each other. This insulating strip 20 is contained within a pair of opposed channels 21 and 22 extending along opposite edges of the entry to a U-shaped channel 23 formed by the rim (see FIGS. 6 and 7). The strip 20 thus covers the entry to the channel 23, but a series of spaced holes 20*a* in the strip admit the rods 11 into the channel. A second insulating strip 24 is contained in a second pair of channels 25 and 26 at the bottom of the U-shaped channel 23. As can be seen in FIG. 7, the end of each conductive rod 11 extends through the insulating strip 20 into the channel 23, and the second insulating strip 24 prevents the ends of the rods from making electrical contact with the bottom of the channel, which is part of the outer wall of the rim 12. The insulating strip 20 serves to hold the ends of the rods 11 in the desired positions relative to each other while at the same time providing electrical isolation between the rods.

Figure 3:
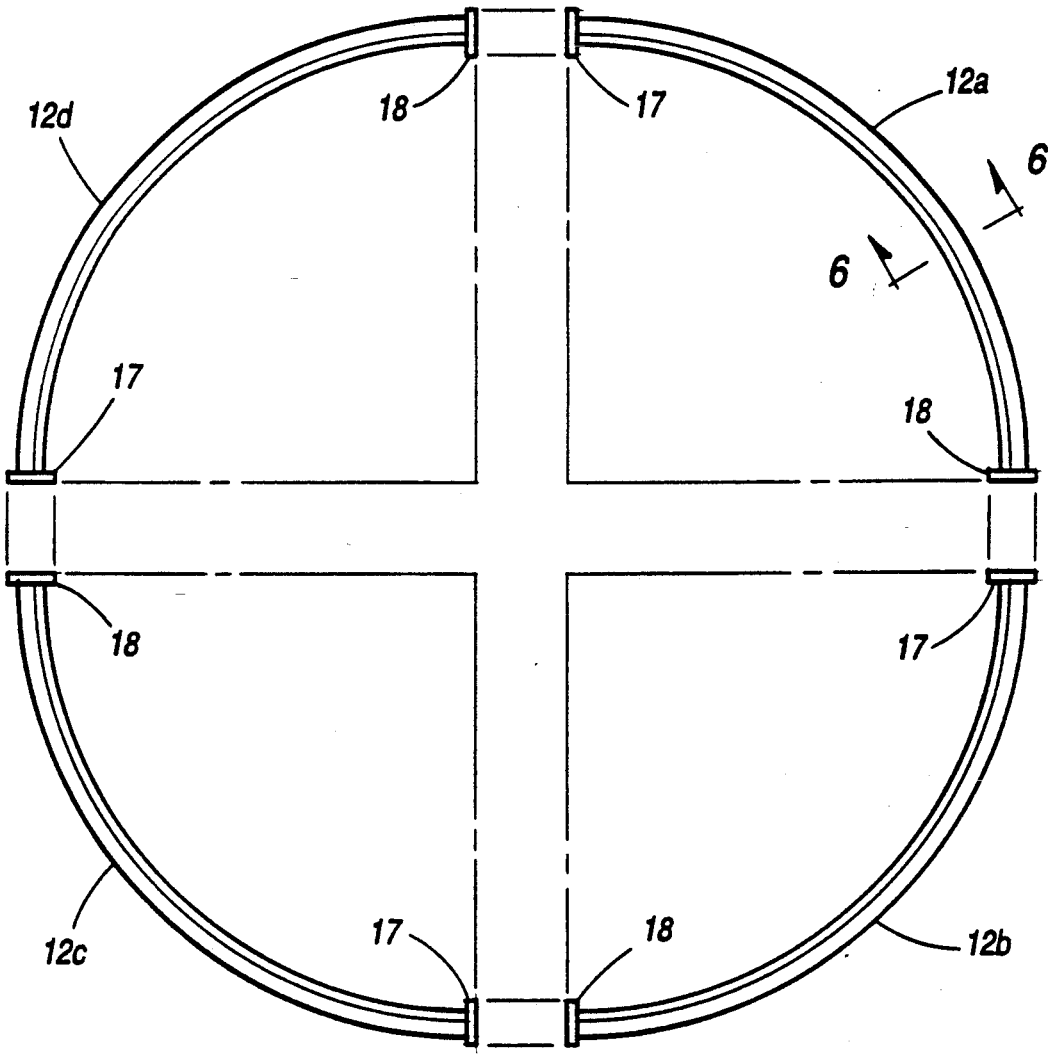
FIG. 3 is a front elevation of the entire rim assembly, illustrating how the four sections of the rim are assembled.

The rim 12 can be initially formed as an aluminum extrusion, as can be seen from the cross-sectional profile in FIG. 3. In the illustrative structure, the rim 12 is formed in four sections 12*a*, 12*b*, 12*c* and 12*d*, each of which forms one quadrant of the circular rim. Each rim section has a pair of connecting flanges 17 and 18 welded to opposite ends thereof so that the rim sections can be attached to each other by bolts inserted through holes provided in each of the flanges 17 and 18. The insulating strips 20 and 24 can be inserted in each rim section through slots 17*a* and 17*b* (FIG. 2) in the flange 17 after both flanges have been welded to the rim section.

As can be seen in FIG. 2, the holes 20*a* in the insulating strip 20 gradually change from circular to increasingly elongated slots having radiused ends to accommodate the changing angle of intersection between the arches 11 and the strip 20 around the circumference of the antenna. It will be appreciated that the dielectric strips 20 in the four rim sections are all interchangeable with each other, as are the four rim sections before the insulating strips 20 and 24 are inserted. This interchangeability, of course, greatly simplifies the manufacturing and stocking processes.

Figure 4:
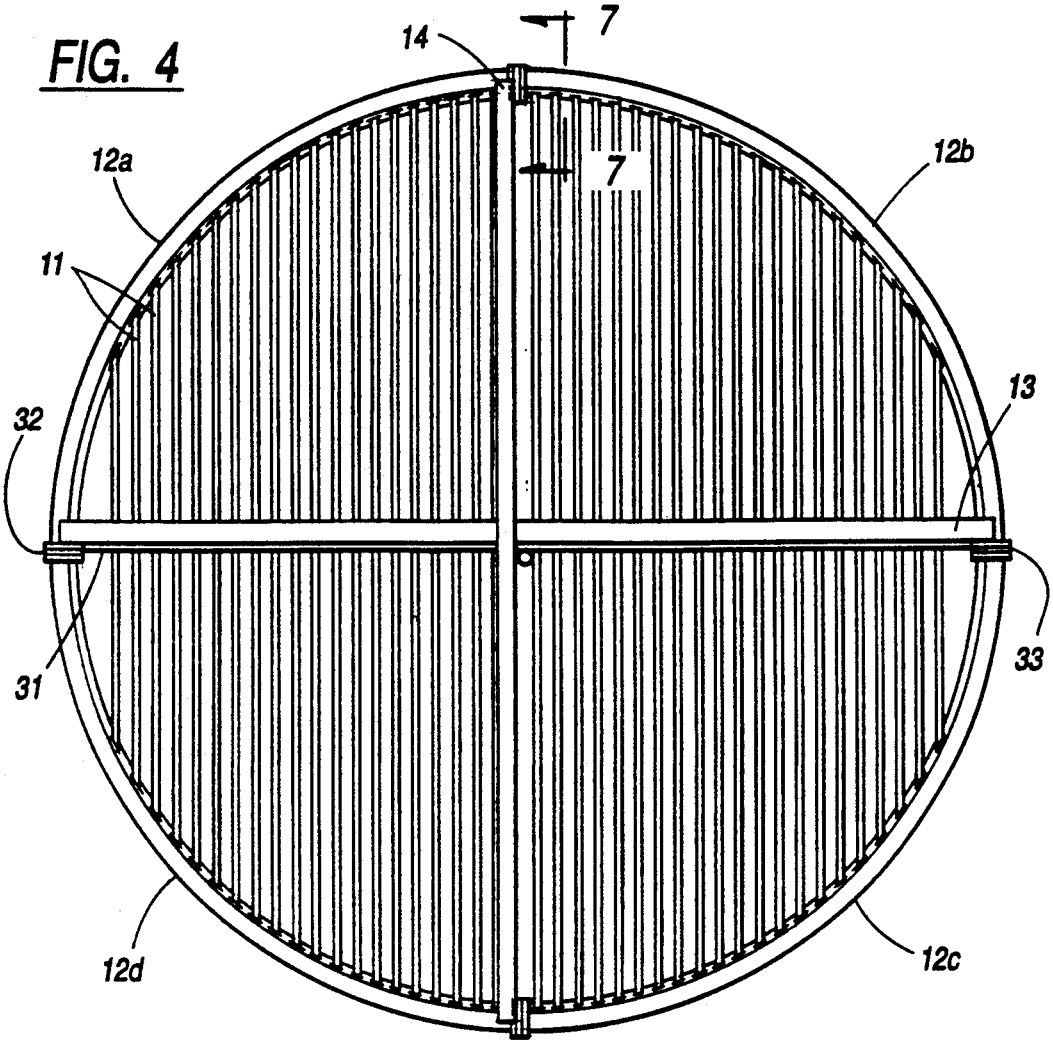
FIG. 4 is a rear elevation of the antenna of FIG. 1.
Figure 5:
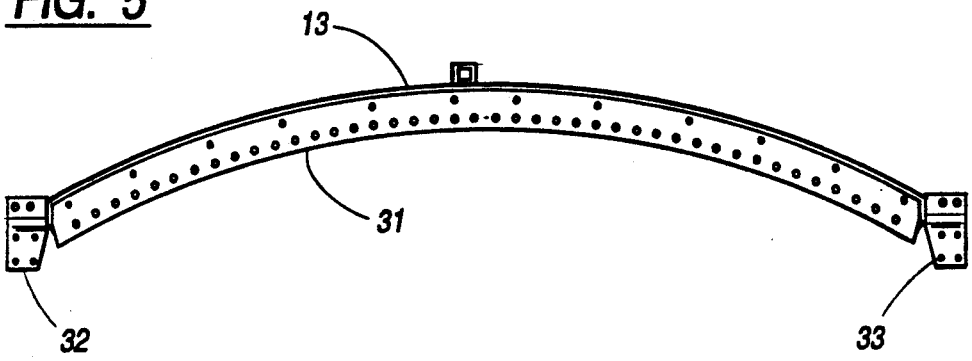
FIG. 5 is a plan view of the horizontal support arch of the antenna as viewed in FIG. 4.

Turning next to FIGS. 4 and 5, the support arch 13 extends diametrically across the rim 12 in a direction perpendicular to the rods 11. This arch 13 is curved to generally follow the paraboloidal contour formed by the entire array of rods 11, and is attached at its opposite ends to the rim 12. Attached to the arch and projecting forwardly therefrom is an insulating strip 31 having multiple holes formed therein for passing the conductive rods 11. The strip 31 thus holds the central portions of the rods 11 in the desired spaced relationship to each other, while also maintaining electrical isolation between adjacent rods.

As can be seen in FIG. 5, the ends of the arch 13 are equipped with mounting plates 32 and 33. Each of these plates 32 and 33 has four holes which register with the holes in the connecting flanges 17 and 18 on the rim sections. During assembly, the plates 32 and 33 are simply positioned between two of the mating pairs of flanges 17, 18 on the rim sections and secured thereto by the same bolts that attach the rim sections to each other.

The second supporting arch 14 (FIGS. 1 and 4) extends diametrically across the rim 12 in a direction that is orthogonal to the arch 13, i.e., parallel to the rods 11. This second arch 14 is located rearwardly of the arch 13, and is fastened to the rim 12 in the same manner as the arch 13. The arch 14 does not directly support the conductive rods 11, but rather is used to strengthen the rim 12 and the overall antenna structure.

The illustrative structure greatly facilitates assembly of the grid antenna 10. The rods 11 are typically numbered at the time of fabrication, so that the assembler need only insert the rods through the central insulating strip 31 in numerical order. The four rim sections 12*a*–12*d*, are then inserted over the ends of the rods, as illustrated in FIG. 3, and then brought into abutting engagement with each other and joined rigidly together by bolting the end flanges 17 and 18.

Another significant advantage of the structure provided by this invention is that the antenna can be easily adapted for use at different frequencies without changing any of the metal parts except the rods 11. As mentioned previously, the spacing between the rods 11 is a function of the operating frequency, and this spacing can be easily changed by simply using different insulating strips 20, 24 and 31 to accommodate a different set of rods 11. The rim sections 12, the arches 13 and 14 and the various elements used to interconnect these members can be the same for all operating frequencies.

When completely assembled, it can be seen that each of the conductive rods 11 is supported by an insulating strip 20 at each end thereof, and by the dielectric strip 31 at the center. Each rod "floats" within these insulating strips, but is held captive therein by the outside wall of the rim 12 which forms the base of the channel 23.

I claim:

1. A grid-type microwave antenna comprising a multiplicity of conductive rods, positioned parallel to each other in spaced apart relationship to each other, each of which is curved along its length to form a section of a paraboloid so that when all the rods are positioned parallel to each other in spaced apart relationship to each other, they form a paraboloidal reflector, and a rim including insulating strips for receiving and holding the ends of said rods to position the rods in spaced apart and parallel relationship to each other.

2. The grid-type microwave antenna of claim 1 wherein said rim forms a channel for receiving the ends of said rods, and which includes a first insulating strip secured to said rim and covering the entry to said channel, said first insulating strip having multiple holes formed therein to admit the ends of said rods into said channel so that the first insulating strip holds the rods in the desired spaced relationship to each other.

3. The grid-type microwave antenna of claim 2 wherein the inside bottom wall of said channel is covered with a second insulating strip to prevent electrical contact with the ends of the rods.

4. The grid-type microwave antenna of claim 1 which includes at least one supporting arch extending across the central portions of said rods, orthogonally to said rods, and connected at its opposite ends to said rim, and an insulating strip attached to said arch and forming multiple holes for passing said rods through said strip attached to said arch so that said strip attached to said arch holds the central portions of said rods in the desired spaced relationship to each other.

5. The grid-type microwave antenna of claim 1 wherein said rim comprises at least two arcuate sections each of which forms no more than one half of said rim.

6. The grid-type microwave antenna of claim 5 which includes connecting means on the ends of each arcuate rim section for rigidly connecting the arcuate rim sections to each other.

7. The grid type microwave antenna of claim 1 wherein said rim comprises four sections, each of which forms one quadrant of the rim.

8. The grid-type microwave antenna of claim 1 wherein said rim is an aluminum extrusion.

9. A method of assembling a grid-type microwave antenna having a paraboloidal reflector formed by an array of parallel conductive rods, said method comprising inserting said rods through an array of spaced holes in a first insulating strip extending orthogonally to said rods, so that when all the rods are positioned parallel to each other in spaced apart relationship to each other, they form a parabolic contour, the array of holes in said first insulating strip following the parabolic contour of said paraboloidal reflector, inserting the ends of said rods at one side of the array of parallel conductive rods through spaced holes in a second insulating strip and into a cavity formed by a first rim section, said second insulating strip being secured to said first rim section, inserting the ends of said rods at the other side of the array of parallel conductive rods through holes in a third insulating strip and into a cavity formed by a second rim section, said third insulating strip being fastened to said second rim section, and joining said first and second rim sections to each other and to said first insulating strip.

10. The method of claim 9 wherein said first insulating strip is secured to a supporting arch which extends diametrically across, and is secured to, the first and second rim sections of the antenna.

11. The method of claim 9 wherein said cavities are formed by channels in said first and second rim sections, and wherein walls of said channels abuts the ends of the conductive rods inserted therein, said walls are lined with insulating material.

* * * * *